United States Patent [19]

Legille et al.

[11] 4,307,987

[45] Dec. 29, 1981

[54] SHAFT FURNACE CHARGING APPARATUS

[75] Inventors: Edouard Legille, Luxembourg; Pierre Mailliet, Howald; René Mahr, Howald, all of Luxembourg; Pierre Mailliet, Allee Drosbach, all of Luxembourg

[73] Assignee: Paul Wurth S.A., Luxembourg

[21] Appl. No.: 57,174

[22] Filed: Jul. 13, 1979

[30] Foreign Application Priority Data

Dec. 12, 1978 [LU] Luxembourg ..... 80646

[51] Int. Cl.[3] ..... F27B 1/20

[52] U.S. Cl. ..... 414/205; 266/176

[58] Field of Search ..... 414/160, 167, 169, 170, 414/199–206; 266/176, 184

[56] References Cited

U.S. PATENT DOCUMENTS

| | | | |
|---|---|---|---|
| 796,784 | 8/1905 | Witherbee | 414/205 |
| 2,560,844 | 7/1951 | Brun et al. | 414/204 |
| 2,586,298 | 2/1952 | Brun et al. | 414/205 |
| 4,116,345 | 9/1978 | Greaves et al. | 414/201 |

*Primary Examiner*—Robert G. Sheridan

*Attorney, Agent, or Firm*—Fishman and Van Kirk

[57] ABSTRACT

The profile of material deposited on the hearth of a pressurized furnace is controlled by means of a charging installation including a lower charging bell which has, suspended therefrom, a variable geometry distributor which may be controlled to select the point of deposition of material delivered to the furnace. The charging bell cooperates with an intermediate storage hopper, positioned within a hermetically sealable casing, whereby the hopper may be alternately filled with material and emptied by permitting the material to fall onto the distributor via an annular opening defined when the bell is lowered.

28 Claims, 4 Drawing Figures

SHAFT FURNACE CHARGING APPARATUS

BACKGROUND OF THE INVENTION

1. Field of the Invention

The present invention relates to the charging of furnaces and particularly to the delivery of material from the ambient atmosphere to the interior of a furnace and the exercise of control over the distribution of the thus delivered material on the furnace hearth. More specifically, the present invention is directed to charging installations for shaft furnaces and particularly to devices for transmitting material to the interior of a pressurized furnace and controlling the distribution of such material within the furnace. Accordingly, the present invention is directed to novel and improved methods and apparatus of such character.

2. Description of the Prior Art

Generally speaking, charging installations for blast furnaces fall into two classifications. The older type of charging installation is characterized by "bells" which perform a valving and flow control function. The other type of furnace charging installation is the "bell-less" type as exemplified by the apparatus disclosed in U.S. Pat. No. 3,693,812. Furnace charging installations of the "bell" type include a plurality of superimposed charging bells which are individually raised and lowered in accordance with a sequence which permits the material with which the furnace is to be charged to be conveyed from the ambient atmosphere to the interior of the furnace at the top or throat area thereof.

Prior furnace charging installations which employ charging bells are known to possess a number of inherent deficiencies when compared to the "bell-less" type of charging installation. These deficiencies include manufacturing problems and furnace operational difficulties. The seriousness of these problems increases in proportion to the dimensions of the charging apparatus and the furnace pressure. In a bell-type charging installation the lower bell, which is the largest in the series of superimposed bells, functions both as a distributor for the charge material released into the furnace and as a shut-off valve which delimits a chamber in which the charge material is temporarily stored. Because of its size and the multiple functions it must perform, the manufacture of a lower charging bell involves major production problems and these problems are aggravated when it becomes necessary to service the installation by removal and replacement of the bell. Also, during normal operation, a considerable amount of equipment is required for raising and lowering the bells, particularly the lower bell, and for establishing the requisite pressure in the chambers which are in part defined by the bells. The complete charging installation thus requires powerful actuators and is usually of considerable height.

One of the major deficiencies of the prior bell-type charging installations resides in the fact that there is practically no way to exercise control of the distribution of the charge material on the charging surface of the furnace. Since the larger lower bell of a bell-type charging installation is in the shape of a truncated cone, it is impossible to avoid the formation of a cavity or depression at the center of the furnace and usually also about the periphery of the charging surface. Thus, charging installations of the bell type are characterized by the establishment of a charge profile which, when viewed in cross section, has the known "M curve". It is well known in the art that the efficiency of operation of a blast furnace may be maximized by controlling a number of operating parameters including the charge profile. For a further discussion of the reasons why exercise of control over the furnace charge profile is important, reference may be had to U.S. Pat. No. 4,094,494. For purposes of the present discussion it should suffice to point out that it is highly desirable to be able to exercise control over the deposition of charge material on the furnace charging surface or hearth and that this operating parameter cannot be controlled in a conventional prior art bell-type charging installation.

There have been efforts to overcome or reduce the seriousness of the above-discussed inherent problems with bell-type furnace charging installations. These efforts have included the positioning of detectors about the lower bell of the charging installation, increasing the number of superimposed bells and modifying the equipment for operating the bells. These efforts have, to date, been largely unsuccessful and have often resulted in proposed solutions which were either economically impractical or would require an unacceptable increase in the overall height of the charging installation which, of course, is mounted on the top of the furnace. Accordingly, most newly constructed large capacity furnaces are equipped with "bell-less" charging installations which include a rotary and angularly adjustable charge distribution chute located within the furnace.

Economic and/or physical limitations may, however, preclude the replacement of a conventional bell-type charging installation with a "bell-less" type installation in some cases. Thus, by way of example, when an existing blast furnace is being repaired, the ability to retain the auxiliary equipment associated with a bell-type charging installation may dictate that the bell-type charging device not be replaced by a "bell-less" charging installation. There thus remains in the industry a strong desire, previously unanswered, for apparatus and techniques which permit a bell-type charging installation to be upgraded in such a manner that true exercise of control over furnace charge profile is possible.

SUMMARY OF THE INVENTION

The present invention significantly reduces the above-discussed deficiencies of prior art bell-type charging installations by providing novel and improved techniques and apparatus which enable the exercise of control over the distribution of charge material delivered to the interior of a furnace. A charging installation in accordance with the present invention is characterized by moderate height, a comparatively uncomplicated mechanism and ease of service.

Apparatus in accordance with a preferred embodiment of the present invention includes a rotary charging hopper which is positioned within a hermetic casing and which, by means of an isolation valve and a charging bell, may be isolated from the ambient atmosphere or the furnace interior as necessary.

Also in accordance with a preferred embodiment of the present invention, the aforementioned rotary charging hopper is mounted coaxially of the furnace and is provided with a base which is movable relative to the hopper. The charging bell, which preferably has a distributor portion of variable geometry, is vertically movable along the furnace axis with the movable base of the rotary charging hopper.

In accordance with one embodiment of the invention, the vertically movable charging bell includes a charge distributor comprised of a "skirt". This "skirt" consists of a plurality of overlapping segments. The "skirt" is coupled to a control mechanism which enables the geometry, and particularly the angle of opening, of the "skirt" to be varied such that the charging material, which falls in an annular pattern, may be directed so as to be deposited in concentric rings which will approximate the desired charging profile. The control over "skirt" geometry may be effected by establishing a connection between the individual segments of the "skirt" and the control apparatus via an actuator having a plurality of arms which extend radially outwardly to engage the "skirt" segments via cooperating slots and lugs. The actuator is, in turn, connected to a vertically movable control rod.

Also in accordance with a preferred embodiment of the present invention, a tubular deflector is positioned between the discharge end of the hopper and the adjustable "skirt" portion of the charging bell. This deflector guides the flow of material from the hopper onto the "skirt" which, in turn, directs the material in the form of a ring onto the charging surface. The adjustment of the opening angle of the "skirt", by means of sliding the control rod in the vertical direction, enables the angle at which this ring of material is discharged to be adjusted and thus the radius of the annular deposit of the charge material to be varied. After each charging cycle, corresponding to the discharge of the contents of the rotary hopper, it is possible to adjust the discharge flow angle to correct the charge profile in accordance with information which may, for example, be provided by a device which scans the profile of the charging surface.

A further important characteristic of the preferred embodiment of the present invention resides in the fact that the device which actually directs the flow of charge material onto the furnace charging surface may be removed from the furnace with relative ease should a maintenance operation become necessary.

A charging installation in accordance with the present invention is characterized by a single "bell" and the actuating devices therefor are mounted in a prolongation of the control shaft for the bell thereby permitting the height of the entire apparatus to be minimized.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures. and in which.

DESCRIPTION OF THE PREFERRED EMBODIMENT

Figure 1:
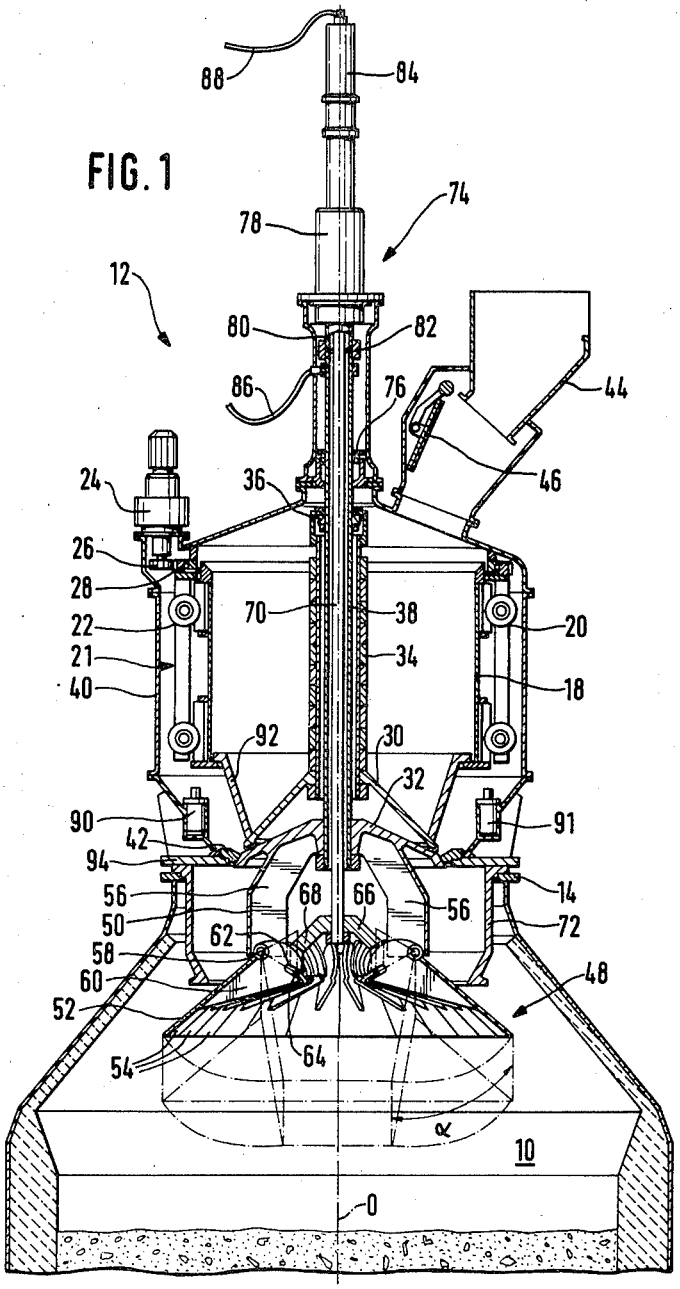
FIG. 1 is a schematic cross-sectional side elevation view of a furnace charging installation in accordance with a preferred embodiment of the present invention, FIG. 1 depicting the apparatus in the charge material receiving state.

With reference to FIG. 1, a charging installation in accordance with a preferred embodiment of the present invention is indicated generally at 12. The charging installation 12 is mounted at the top of a blast furnace 10. The furnace 10 has a central axis "0" and the charging installation is supported on a ring-shaped flange 14 which forms part of the throat or neck portion of furnace 10; flange 14 being coaxial with furnace axis "0".

The charging installation includes an open topped charging hopper 18 which forms part of a rotary cage; the rotary cage being indicated generally at 21. Vertical movement of cage 21, including hopper 18, is permitted by means of pairs of guide rollers as indicated at 20 and 22. The rollers of each pair may include cooperating concave and convex surfaces with the vertically oriented roller having the convex surface and being mounted on the hopper 18 as shown. Rotary motion of the cage 21 is produced by a drive motor 24. The motion of the output shaft of motor 24 is coupled to cage 21 via a drive including pinion 26 and bearing 28.

The lower end of hopper 18 is in the form of a funnel 92. Hopper 18 is supported, via funnel 92, on a conical base 30. The base 30, in addition to supporting hopper 18, functions as a wear cone for protecting a bell 32. Base 30 is integral with a tubular cover or housing 34 which is coaxial with the furnace axis "0". The cover 34, in the disclosed embodiment, is formed of a series of segments comprised of a suitable wear-resisting material since cover 34 is exposed to the abrasive action of the furnace charge material. Tubular cover 34 serves as a protective housing for a tubular suspension bar 38 to which the bell 32 is affixed; the connection between cover 34 and tubular bar 38 being by means of a support bearing 36.

For the reason to be set forth below, motor 24 may be energized to impart an oscillatory movement to the assembly comprised of cage 21, the vertical guide members including roller pairs 20 and 22, hopper 18, base 30 and tubular protective cover 34. Vertical movement of the tubular suspension bar 38, produced in the manner to be described below, will cause hopper 18 to move vertically.

The hopper 18 is positioned within a casing 40. Casing 40 is hermetically sealed, at its lower end, to flange 14 via a further ring-shaped flange 94. A valve seat defining member 42 is provided at the lower end of casing 40, about the periphery of the opening in flange 94, and cooperates with the bell 32 to perform a valve function. Thus, with bell 32 in the raised position as shown in FIG. 1, a hermetic seal will exist between the interior of the furnace 10 and the interior of casing 40. Casing 40, at its upper end, communicates with a receiving spout 44 via an extension which houses a shut-off valve 46. With bell 32 in contact with seat 42, the valve 46 may be opened and the material with which the furnace is to be charged dropped into hopper 18 via spout 44 from transport devices of the type known in the art; i.e., skips or a conveyor belt. After hopper 18 has been loaded, the valve 46 will be closed and the interior of casing 40 will be raised to approximately the pressure existing within furnace 10 by means, known in the art, which have been omitted from the drawing in the interest of facilitating understanding of the invention.

In accordance with the present invention, a veriable geometry conical distributor, indicated generally at 48, is suspended from bell 32 by means of a support member 50 which is integral with bell 32. The distributor 48 thus follows the ascending and descending movements of bell 32 which result, in the manner to be described below, from imparting vertical motion to the tubular suspension bar 38. As noted above, in FIG. 1 the bell 32 is shown in its uppermost or sealing position. A lower position for distributor 48 is indicated on FIG. 1 by means of a broken line showing. The distributor 48 includes a segmented "skirt" 52. Each of the segments 54 of skirt 52 consist of a sector of an annular surface, slightly curved, whereby a frusto-conical charge distribution member may be defined when the "skirt" is in the condition depicted in FIG. 1 with minimum overlapping of the segments 54; this frusto-conical distribution surface being coaxial with the axis "0" of the furnace 10.

Continuing with a description of the distributor 48, the support member 50 is provided with a plurality of inwardly extending ribs 56. The number of ribs 56 will correspond to the number of segments 54 of "skirt" 52. Each "skirt" segment 54 is articulated to a corresponding rib 56 via a pivot 58. It will be understood that, as long as support for the pivots 58 is provided, it is not necessary for each of the ribs 56 to extend all the way upwardly to the bell 32. Each of "skirt" segments 54 is provided, extending inwardly from its internal concave surface, with a web 60. The webs 60 may comprise a plate welded to the segment or perpendicular extension formed during casting of the segment. The webs 60 are each provided with a slot 62 which receives a drive pin 64. The drive pins 64 extend transversely from the lower ends of the radial fingers or points 68 of a "star-shaped" plate 66. The number of fingers 68 of the plate 66 will correspond to the number of segments 54 of "skirt" 52. The plate 66 is affixed to the lower end of a control rod 70 which passes through bell 32 and extends upwardly through the tubular suspension bar 38. Control rod 70, in the manner to be described below, is vertically movable relative to the suspension bar 38 and thus plate 66 is vertically movable with respect to bell 32.

Figure 2:
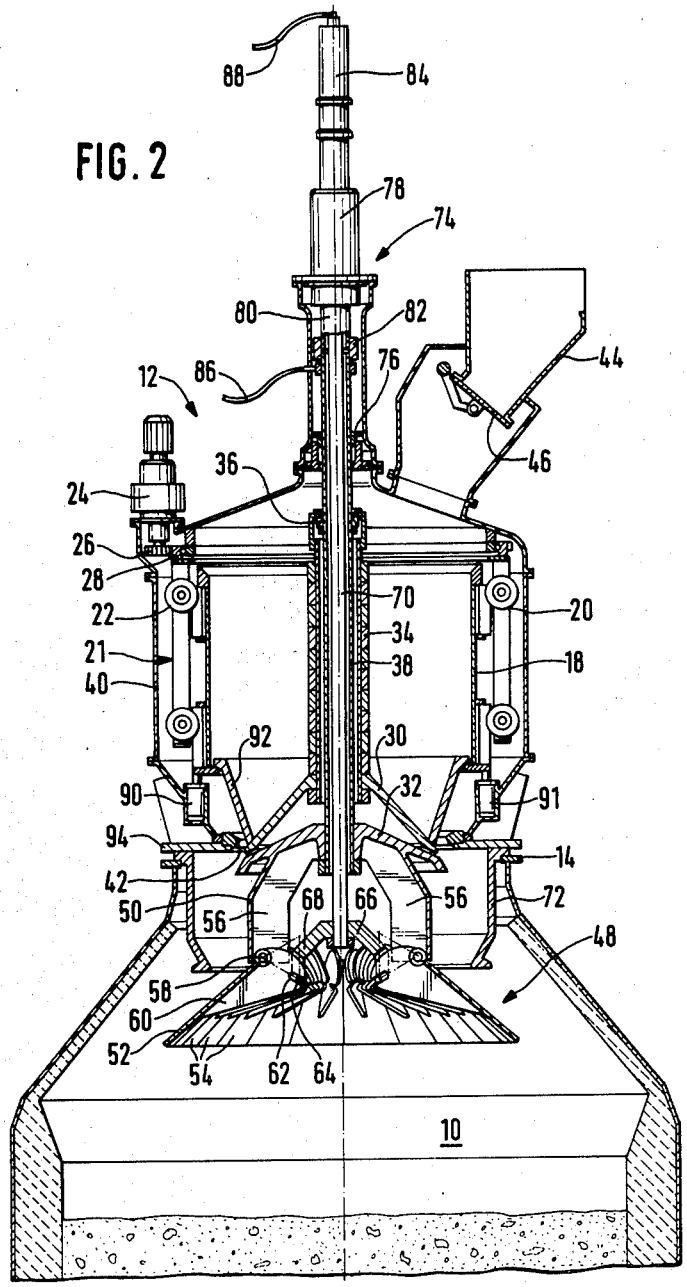
FIG. 2 is a view similar to FIG. 1 but depicting the apparatus in a further stage of a furnace charging cycle.
Figure 3:
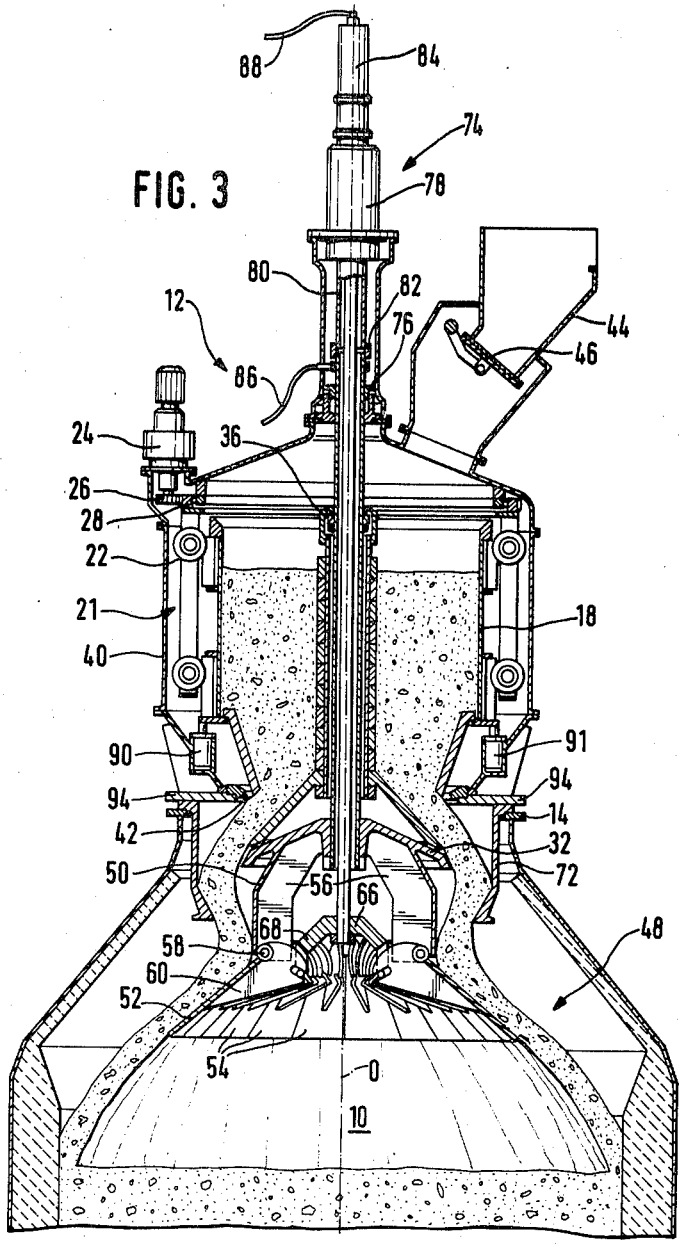
FIG. 3 is a view similar to FIG. 1, but also representing the charge material, depicting the apparatus in a further phase of a charging cycle.

The angular position of each of "skirt" segments 54 relative to furnace axis "0"; i.e., the degree of tilt of segments 54 about pivots 58; is determined by the position of plate 66 relative to bell 32. Thus, when plate 66 occupies its lowest position relative to bell 32, the segments 54 pivot outwardly about pivots 58 and the angle of opening of "skirt" 52 is at its maximum as shown in FIGS. 1, 2 and 3. By raising plate 66 toward bell 32, through imparting vertical motion to control rod 70, the outwardly disposed ends of segments 54 are lowered in the direction of furnace axis "0" and the angle of opening of "skirt" 52 decreases progressively until it reaches the position shown in FIG. 4. Between the two extreme positions shown in FIGS. 1 and 4, where the conicity of distributor 48 is generally opposite, the "skirt" 52 passes through a cylindrical position.

Figure 4:
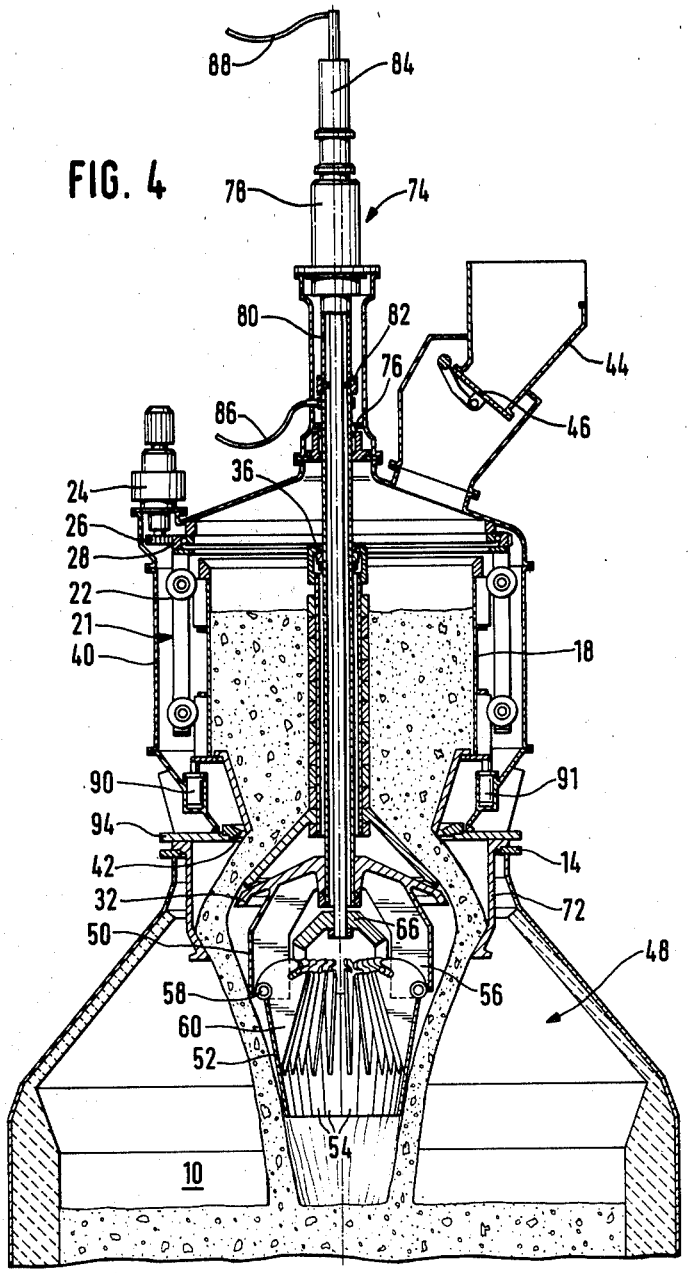
FIG. 4 is a view similar to FIG. 3 but depicting the deposition of the charge material at a different point on the furnace hearth.

In one version of the invention the pivoting angle, indicated at $\alpha$ in FIG. 1, of each of segments 54 of "skirt" 52; i.e., the angle between the extreme positions of FIGS. 1 and 4; is 60°. During the vertical movement of plate 66, the drive pins 64 slide in their respective slots 62 in the webs 60 of "skirt" segments 54 to translate the vertical movement of pins 64 to pivoting movement of segments 54 about pivots 58. When the angle $\alpha$ is equal to 60°, the axis of the slots 62 in webs 60 should preferably occupy an angle of approximately 30° relative to a horizontal plane passing through pivots 58.

The number of segments 54 of "skirt" 52 must naturally be a devisor of 360. The number of segments 54 must also be sufficiently great to minimize the effects of thermally induced expansion and to achieve the desired geometry. Thus, it has been found that there should be at least sixteen, and preferably twenty-four, segments 54 of "skirt" 52. If the width of the individual segments is excessive at their lower ends, obviously "skirt" 52 would not be able to close to a sufficient degree. If the segments are too large, expansion thereof will not be kept within acceptable limits.

The segments 54, since they are exposed to the erosive effects of the falling furnace charge material and to the severe temperature and pressure conditions within the furnace 10, will be comprised of a refractory steel having good wear-resisting properties.

A deflector 72, which has a circular cross section when viewed in the vertical direction, partly circumscribes the distributor 48. Deflector 72, at its lower end, is convergent in the direction of furnace axis "0" and thus directs charge material flowing out of hopper 18 onto the "skirt" 52 of distributor 48.

An actuator unit, indicated generally at 74, controls the vertical position of bell 32 and the angle of opening of "skirt" 52. Control unit 74 is mounted above the hermetically sealed casing 40 in an extension thereof. The tubular suspension bar 38, to which bell 32 is connected, extends through casing 40 via a stuffing box and is connected to the tubular piston rod 80 of a hydraulic jack 78 via a removable collar 82. The control rod 70, to which plate 66 of distributor 48 is connected, passes through suspension tube 38 and the piston rod 80 of jack 78 and is connected to the piston rod of a second hydraulic jack 84 mounted above jack 78. In the disclosed embodiment the upper hydraulic jack 84 is integral with the piston of jack 78 and thus jack 84 follows the vertical movements of the tubular suspension bar 38.

Portions of distributor 48 and the control mechanism therefor may be cooled by the passage of suitable coolant therethrough. The coolant is delivered to the apparatus via conduits 86 and 88. In accordance with one embodiment of the invention, conduit 86 delivers coolant to a plurality of pipes, not shown, which are arranged in a ring between suspension tube 38 and control rod 70. These pipes will convey the coolant to passages which extend through ribs 56, pivots 58, "skirt" segments 54 and possibly also the webs 60. A second cooling liquid circulation system, fed by conduit 88, may be provided through control rod 70 and downwardly into the plate 66 and the fingers 68 thereof. The cooling of plate 66 and the segments 54 of the distributor "skirt" 52 increases the mechanical strength of and thus minimizes the possibility of deformation of these elements.

The operation of the disclosed embodiment of the present invention will now be described. As used herein, the term "cycle" will correspond to a single filling and subsequent emptying of the hopper 18. A complete charging of furnace 10 will require a plurality of such cycles. In order to enable the charging hopper 18 to be loaded with the particulate material which is subsequently to be delivered to the furnace hearth, the lower bell 32 must be urged tightly against the seat 42 by the action of hydraulic actuator 78 so that the interior of casing 40 will be hermetically isolated from the interior of furnace 10. Once this hermetic isolation has been achieved, casing 40 may be depressurized and valve 46 opened so that the charge material may be introduced into hopper 18 via receiving spout 44. In order to insure even filling of hopper 18, motor 24 will be energized to impart either a continuous or intermittant rotary motion to hopper 18 depending upon whether the furnace charge material is being supplied to spout 44 by a conveyor belt or by a skip installation. When hopper 18 is filled the valve 46 is closed and the interior of casing 40 is pressurized, by means known in the art, to a level approximately equal to the pressure existing in the furnace 10. Once the interior of casing 40 has been pressurized, the hydraulic jack 78 will be operated to lower suspension bar 38 and thus bell 32. Since hopper 18 rests on conical base 30, which is connected to suspension bar 38, hopper 18 will initially move downwardly with bell 32; the hopper moving on the guiding system comprising roller pairs 20 and 22. When hopper 18 reaches the position shown in FIG. 2, a flange at the lower end thereof will contact a plurality of dampers such as those indicated at 90 and 91. During the vertical movement of hopper 18 the motor 24 will be inoperative.

In the positon shown in FIG. 2, with further downward movement of hopper 18 prevented by dampers 90 and 91, the funnel portion 92 at the lower end of hopper 18 will form a protective shield about the seating member 42 and particularly the sealing surface thereof which cooperates with bell 32. As the suspension bar 38 continues its downward movement, base 30 separates from funnel 92 and the bottom of hopper 18 is progressively opened until it reaches its maximum opening position as shown in FIG. 3. With bell 32 in its lowermost position as shown in FIG. 3, the charge material previously loaded into hopper 18 is released so as to fall, under the influence of gravity, in a trajectory determined by the combined action of conical base 30, the deflector 72 and the "skirt" 52. As bell 32 moves downwardly from the position shown in FIG. 2 to that of FIG. 3, the jack 84, control rod 70 and variable geometry distributor 48 will also continue to move downwardly.

With "skirt" 52 in the condition shown in FIG. 3, with maximum opening, the material discharged from hopper 18 will be deflected so as to form an annular peripheral deposit on the charging surface of the furnace. In order to deposit material in the central region, about the furnace axis "0", the jack 84 will be actuated to move plate 66 upwardly toward bell 32 whereby "skirt" 52 "folds" until it reaches the position depicted in FIG. 4. In the FIG. 4 position, "skirt" 52 is generally outside of the trajectory of the falling charge material and this trajectory is determined primarily by the convergent lower end of deflector 72. The position of the annular deposit of charge material released from hopper 18 may, of course, be directed to any intermediate region between the regions shown in FIGS. 3 and 4 by selecting an appropriate opening angle for "skirt" 52.

In accordance with one characteristic of the present invention, the seat member 42 is bolted to the upper surface of lower flange 94 of casing 40 and has an inner diameter greater than the maximum outer diameter of bell 32 and distributor 48. This enables the assembly, including bell 32 and distributor 48, to be dismantled and removed via flange 94 subsequent to removal of seat 42 and funnel portion 92 of hopper 18. In order to permit its removal through the opening in flange 94, distributor 48 must be in the condition shown in FIG. 4.

The mounting of actuator unit 74 on top of casing 40 enables the entire charging installation to be characterized by moderate height and also permits dispensing with the usual bell tower. The comparatively low contour of the charging installation also results from the fact that the present invention requires only a single bell and the distributor 48 may be installed comparatively close to bell 32 since there is no storage of material between the bell and distributor.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. Apparatus for delivering particulate matter to the interior of a furnace comprising:

casing means, said casing means defining an enclosure, said casing means being hermetically coupled to the furnace, said casing means defining a valve seat at the lower end thereof;

hopper means, said hopper means being encompassed within said casing means, said hopper means having an opening at its upper end, said hopper means receiving and storing materials to be delivered from the ambient environment to the interior of the furnace;

means for delivering material to said hopper means from the ambient environment, said delivering means including first valve means for selectively hermetically isolating the interiors of said casing means and said hopper means from the ambient environment;

hopper means base means, said base means at least in part supporting material delivered to said hopper means when the interior of said hopper means is isolated from the furnace interior;

means for supporting said casing means and said hopper means on and generally above the furnace;

second valve means, said second valve means being positioned within the furnace, said second valve means cooperating with said casing means defined valve seat to define an isolation valve whereby said hopper means and said casing means may be jointly selectively hermetically isolated from the interior of the furnace;

means for imparting vertical motion to said second valve means to selectively isolate the interior of said casing means and said hopper means from the furnace interior and to open the interiors of said casing means and said hopper means to the furnace interior to thereby permit release of material delivered to said hopper means into the furnace via the isolation valve;

distributor means suspended in the furnace from said second valve means, said distributor means having a variable geometry, said distributor means in part directing the flow of material released from said hopper means; and means for varing the geometry of said distributor means to thereby control the pattern of deposition of material on a surface in the furnace.

2. The apparatus of claim 1 wherein the furnace has an axis, said second valve means and distributor means are mounted coaxially of the furnace axis and said hopper means is coaxial with an extension of the furnace axis.

3. The apparatus of claim 2 wherein said hopper means base means is movable along said axis with said second valve means and relative to said hopper means to define a flow opening for material traveling from said hopper means to the furnace when said second valve means is in the open position.

4. The apparatus of claim 3 further comprising:
means supporting said hopper means within said casing means for rotation about the furnace axis extension and relative to said delivering means; and
means for imparting rotary motion to said hopper means.

5. The apparatus of claim 3 further comprising:
means supporting said hopper means in said casing for limited vertical movement relative thereto with said base means; and
stop means for supporting said hopper means and preventing vertical movement thereof in excess of said limit during movement of said base means to define the material flow opening.

6. The apparatus of claim 5 further comprising:
means for mounting said hopper means supporting means in said casing means for rotation about the furnace axis extension and relative to said delivering means; and
means for imparting rotary motion to said hopper means.

7. The apparatus of claim 1 wherein said distributor means comprises:
a plurality of overlapping plate segments; and
means mounting said plate segments for pivotal motion about axes lying in a common plane, the pivotally mounted overlapping segments defining an annular surface of variable outer diameter.

8. The apparatus of claim 7 wherein said means for mounting said plate segments for pivotal motion comprises:
suspension means integral with said second valve means, said suspension means being supported from the lower side of said second valve means and including pivot connections equal in number to said plate segments.

9. The apparatus of claim 7 wherein said distributor means geometry varying means comprises:
actuator means coupled to each of said plate segments for causing pivoting thereof, said actuator means including control rod means which extends to a location at the exterior of the furnace via said receiving and storing means.

10. The apparatus of claim 9 wherein said plate segments each include a web member which extends radially inwardly toward the furnace axis, said web members each being provided with an actuating slot, and wherein said actuator means further includes:
plate means, said plate means being mounted on said control rod means for vertical movement therewith, said plate means having a plurality of fingers which extend generally radially outwardly with respect to the furnace axis; and
drive pin means extending from each of said plate means fingers, said pin means being accepted in actuating slots of respective of said plate segments.

11. The apparatus of claim 10 wherein the furnace has an axis and wherein said second valve means and distributor means are positioned coaxially of the furnace axis, said hopper means is positioned coaxially of an extension of the furnace axis and said control rod means extends along the furnace axis through said hopper means.

12. The apparatus of claim 11 wherein said means for mounting said plate segments for pivotal motion comprises:
suspension means integral with said second valve means, said suspension means being supported from the lower side of said second valve means and including pivot connections equal in number to said plate segments.

13. The apparatus of claim 12 wherein said distributor means comprises at lease sixteen of said plate segments.

14. The apparatus of claim 12 wherein said distributor means comprises at least twenty-four of said plate segments.

15. The apparatus of claim 9 wherein said means for imparting vertical motion to said second valve means comprises:
a tubular control shaft, said tubular control shaft being coaxial of said control rod means;
fluidic actuator means positioned to the exterior of said receiving and storing means for imparting vertical motion to said tubular control shaft, said fluidic actuator means including a piston and simultaneously imparting said vertical motion to said control shaft and said control rod means; and wherein said actuator means for said control rod means comprises:
means mounted for movement with the piston of said fluidic actuator means for causing relative movement between said control shaft and said control rod means.

16. The apparatus of claim 9 wherein the furnace has an axis and wherein said second valve means and distributor means are positioned coaxially of the furnace axis, said hopper means is positioned coaxially of an extension of the furnace axis and said control rod means extends along the furnace axis through said hopper means.

17. The apparatus of claim 16 wherein said hopper means base means is movable along said axis with said second valve means and relative to said hopper means to define a flow opening for material traveling from said hopper means to the furnace when said second valve means is in the open position.

18. The apparatus of claim 17 further comprising:
means supporting said hopper means in said casing for limited vertical movement relative thereto with said base means; and
stop means for supporting said hopper means and preventing vertical movement thereof in excess of said limit during further movement of said base means to define the material flow opening.

19. The apparatus of claim 18 further comprising:
means for mounting said hopper means supporting means in said casing means for rotation about the furnace axis extension and relative to said delivering means; and
means for imparting rotary motion to said hopper means.

20. The apparatus of claim 16 further comprising:
deflector means, said deflector means extending into said furnace from said hopper means supporting means, said deflector means being of tubular construction and having a convergent lower wall portion, said convergent lower wall portion of said deflector means directing material passing through the isolation valve toward said distributor means.

21. The apparatus of claim 20 further comprising:
deflector means, said deflector means extending into said furnace from said receiving and storing means supporting means, said deflector means being of tubular construction and having a convergent lower wall portion, said convergent lower wall portion of said deflector means directing material passing through the isolation valve toward said distributor means.

22. The apparatus of claim 1 further comprising:

deflector means, said deflector means extending into said furnace from said hopper means supporting means, said deflector means being of tubular construction and having a convergent lower wall portion, said convergent lower wall portion of said deflector means directing material passing through the isolation valve toward said distributor means.

23. The apparatus of claim 1 wherein said means for imparting vertical motion to said second valve means comprises an elongated control member which extends to the exterior of said receiving and storing means, said control member being mounted for sliding movement in the vertical direction; and means positioned to the exterior of the furnace and said receiving and storing means for imparting vertical motion to said control member.

24. Apparatus for delivering particulate matter to the interior of a furnace comprising:

means for receiving and storing materials to be delivered from the ambient environment to the interior of the furnace, said receiving and storing means being hermetically coupled to the furnace and including hopper means;

means for supporting said receiving and storing means on and generally above the furnace;

means for delivering material to said receiving and storing means hopper means, said delivering means including first valve means for selectively hermetically isolating the interior of said receiving and storing means from the ambient environment;

second valve means positioned within the furnace, said second valve means cooperating with a portion of said receiving and storing means to define an isolation valve at the lower end of said receiving and storing means;

means for imparting vertical motion to said second valve means to selectively isolate the interior of said receiving and storing means from the furnace interior and to open the interior of said receiving and storing means to the furnace interior to thereby permit release of material delivered to said hopper means into the furnace via the isolation valve;

distributor means suspended in the furnace from said second valve means, said distributor means having a variable geometry, said distributor means in part directing the flow of material released from said hopper means, said distributor means comprising:

a plurality of overlapping plate segments, said plate segments each including a web member which extends radially inwardly toward the furnace axis, said web members each being provided with an actuating slot; and means mounting said plate segments for pivotal motion about axes lying in a common plane, the pivotally mounted overlapping segments defining an annular surface of variable outer diameter; and actuator means, said actuator means varying the geometry of said distributor means to thereby control the pattern of deposition of material on a surface in the furnace, said actuator means being coupled to each of said plate segments for causing pivoting thereof said actuating means including:

control rod means which extends to a location at the exterior of the furnace via said receiving and storing means;

plate means, said plate means being mounted on said control rod means for vertical movement therewith, said plate means having a plurality of fingers which extend generally radially outwardly with respect to the furnace axis; and drive pin means extending from each of said plate means fingers, said pin means being accepted in actuating slots of respective of said plate segments.

25. The apparatus of claim 24 wherein the furnace has an axis and wherein said second valve means and said distributor means are positioned coaxially of the furnace axis, said hopper means is positioned coaxially of an extension of the furnace axis and said control rod means extend along the furnace axis through said hopper means.

26. The apparatus of claim 25 wherein said means for mounting said plate segments for pivotal motion comprises:

suspension means integral with said second valve means, said suspension means being supported from the lower side of said second valve means and including pivot connections equal in number to said plate segments.

27. The apparatus of claim 26 wherein said distributor means comprises at least sixteen of said plate segments.

28. The apparatus of claim 26 wherein said distributor means comprises at least twenty-four of said plate segments.

* * * * *